US007433631B2

(12) United States Patent
Karz et al.

(10) Patent No.: US 7,433,631 B2
(45) Date of Patent: Oct. 7, 2008

(54) MATERIAL SUPPLY MODULE DRIVE SHAFT

(75) Inventors: Robert S. Karz, Webster, NY (US); John G. Shaw, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 258 days.

(21) Appl. No.: 11/314,894

(22) Filed: Dec. 20, 2005

(65) Prior Publication Data

US 2007/0140735 A1 Jun. 21, 2007

(51) Int. Cl.
*G03G 15/00* (2006.01)
*G03G 21/16* (2006.01)
*G03G 15/08* (2006.01)

(52) U.S. Cl. ..... 399/167; 399/111; 399/262

(58) Field of Classification Search ..... 399/111, 399/113, 119, 167, 262, 263
See application file for complete search history.

(56) References Cited

U.S. PATENT DOCUMENTS

| | | | | |
|---|---|---|---|---|
| 5,903,803 | A | 5/1999 | Kawai et al. | 399/116 |
| 6,029,032 | A | 2/2000 | Watanabe et al. | 399/111 |
| 6,035,159 | A | 3/2000 | Azuma et al. | 399/111 |
| 6,128,454 | A | 10/2000 | Kawai et al. | 399/116 |
| 6,163,665 | A | 12/2000 | Watanabe et al. | 399/111 |
| 6,173,146 | B1 | 1/2001 | Wang et al. | 399/265 |
| 6,324,363 | B1 | 11/2001 | Watanabe et al. | 399/111 |
| 6,330,409 | B1 | 12/2001 | Watanabe et al. | 399/111 |
| 6,336,018 | B1 | 1/2002 | Kawai et al. | 399/117 |
| 6,349,188 | B1 | 2/2002 | Kawai et al. | 399/116 |
| 6,501,926 | B1 | 12/2002 | Watanabe et al. | 399/117 |
| 6,829,455 | B2 | 12/2004 | Yasumoto et al. | 399/167 |
| 6,885,838 | B2 | 4/2005 | Kawai et al. | 399/167 |
| 6,901,229 | B2 | 5/2005 | Nishiuwatoko et al. | 399/167 |
| 2003/0059233 | A1* | 3/2003 | Jang et al. | 399/167 |
| 2005/0163526 | A1 | 7/2005 | Shizuoka-ken et al. | |

* cited by examiner

*Primary Examiner*—Hoang Ngo
(74) *Attorney, Agent, or Firm*—Wiggin and Dana LLP

(57) ABSTRACT

A drive shaft for coupling with a drive gear having a gear shaft extending outwardly therefrom. The gear shaft includes a twisted triangular coupling hole having defined vertices. The drive shaft includes a cylinder flange joined to one end of a drive shaft cylinder, the cylinder flange having a concentric shaft extending outwardly therefrom and a plurality of members extending longitudinally outwardly from the concentric shaft, wherein the members are adapted to fit within the twisted triangular coupling hole. The plurality of members may include parallelogram-shaped prongs. Alternatively, a rod extends outwardly from the concentric shaft. The rod has three skewed blades that extend radially outwardly therefrom. Another aspect is a material supply module including a drive shaft.

18 Claims, 6 Drawing Sheets

MATERIAL SUPPLY MODULE DRIVE SHAFT

BACKGROUND

Many copiers, facsimile apparatus, printers, and similar electrostatographic image forming devices include a replaceable or refillable material supply module. The material supply module is typically connected to a device via a drive shaft and gear shaft coupling arrangement, which generally includes a drive shaft integral to the module that interacts with a gear shaft integral to the particular device.

FIG. 1 shows a drive shaft and gear shaft coupling arrangement 20, which is currently used in the material supply module of copiers, facsimile apparatus, printers, and similar electrostatographic image forming devices. A drive gear 22 drives a driveshaft cylinder 24 of a drive shaft 25. Drive gear 22 includes a gear shaft 26 at its center and an outside edge 28 having gear teeth. Gear shaft 26 has a front surface 30, which includes a twisted triangular coupling hole 32 having defined vertices 33 formed therein. Driveshaft cylinder 24 is fixedly mounted with a cylinder flange 34, which includes an axially outwardly extending concentric shaft 36 and an outside edge 38 having gear teeth. Concentric shaft 36 includes an axially outwardly twisted, triangular coupling member 40, which is axially raised from an outer surface 42 of the shaft for coupling to twisted triangular coupling hole 32 on gear shaft 26 of drive gear 22.

During the life of a device, driveshaft cylinder 24 and drive shaft 25 may be replaced one or more times depending on the frequency of use. Cylinder flange 34 is typically replaced when driveshaft cylinder 24 and drive shaft 25 are replaced. Because twisted triangular coupling member 40 of cylinder flange 34 generally twists in one direction and its torque forces are adjacent its axis of rotation, its fabrication is both complicated and expensive. In addition, because the torque forces acting on twisted triangular coupling member 40 of cylinder flange 34 are adjacent its axis of rotation, the member encounters high stresses.

BRIEF SUMMARY

According to one aspect, there is provided a drive shaft for coupling with a drive gear having a gear shaft extending outwardly therefrom, the gear shaft including a twisted triangular coupling hole having defined vertices. The drive shaft includes a cylinder flange joined to one end of a drive shaft cylinder, the cylinder flange having a concentric shaft extending longitudinally outwardly therefrom and a plurality of members extending longitudinally outwardly from the concentric shaft, wherein the members are adapted to fit within the twisted triangular coupling hole.

According to another aspect, there is provided a module installable in a printing apparatus. The module is adapted for coupling with a drive gear, the drive gear having a gear shaft extending outwardly therefrom. The gear shaft includes a twisted triangular coupling hole having defined vertices therein. The module includes a housing and a drive shaft joined with the housing. The drive shaft includes a cylinder flange joined to one end of a drive shaft cylinder. The cylinder flange has a concentric shaft extending longitudinally outwardly therefrom and the concentric shaft includes an outer surface that is configured to be substantially parallel to a front surface of the gear shaft. A plurality of members extend outwardly from the outer surface of the concentric shaft. The members include a mechanism for engaging the twisted triangular coupling hole.

According to yet another aspect, there is provided a drive shaft for coupling with a drive gear having a gear shaft extending outwardly therefrom. The gear shaft includes a twisted triangular coupling hole having defined vertices. The drive shaft includes a cylinder flange joined to one end of a drive shaft cylinder. The cylinder flange has a concentric shaft extending longitudinally outwardly therefrom. A rod extends outwardly from the concentric shaft. The rod has three skewed blades extending radially outwardly therefrom and the rod and blades are adapted to fit within the twisted triangular coupling hole.

BRIEF DESCRIPTION OF THE DRAWING

Referring now to the figures, which are exemplary embodiments, wherein like items are numbered alike.

DETAILED DESCRIPTION

Figure 1:
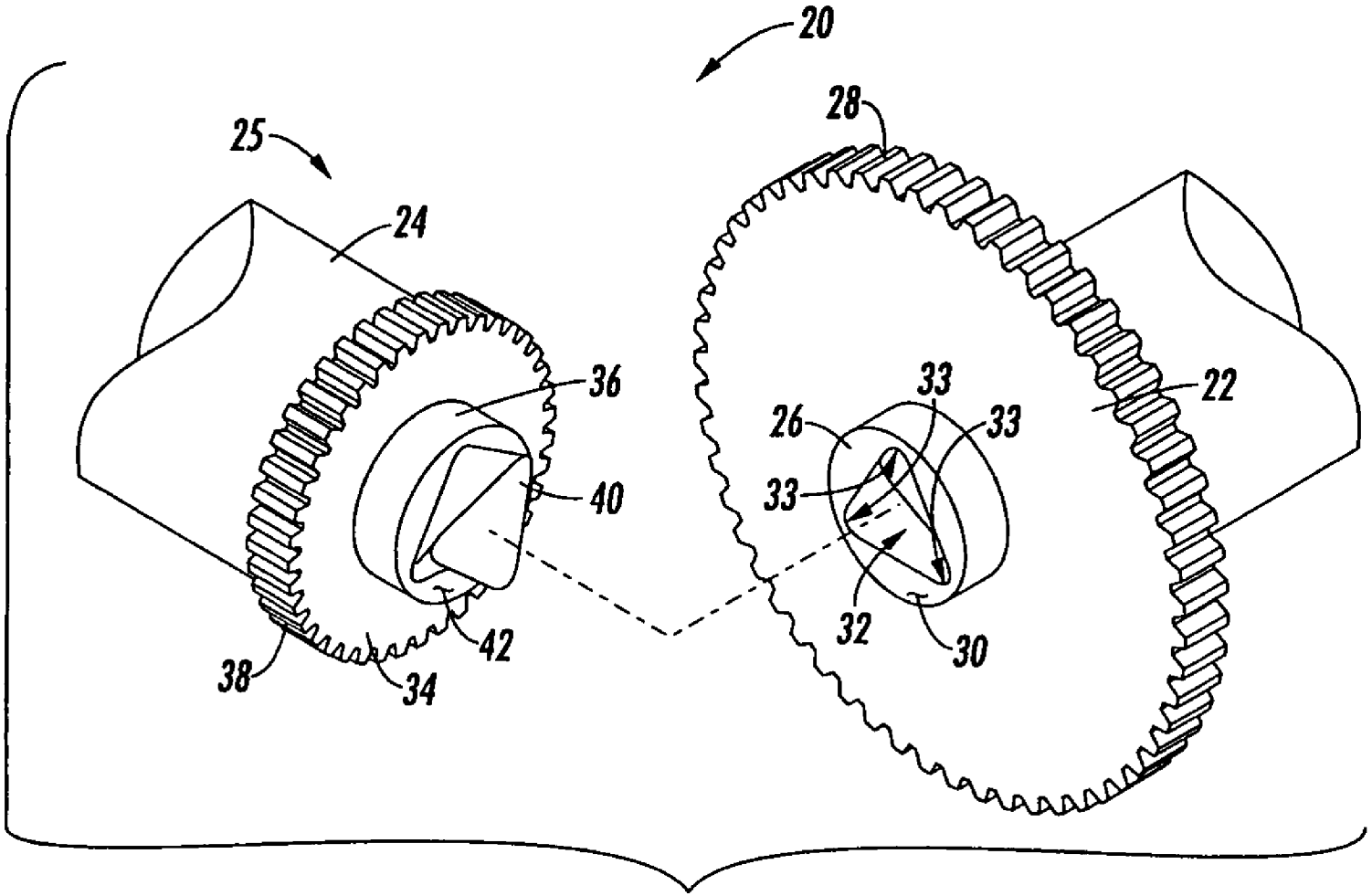
FIG. 1 (PRIOR ART)
FIG. 1 is a prior art drive shaft and gear shaft coupling arrangement.
Figure 2:
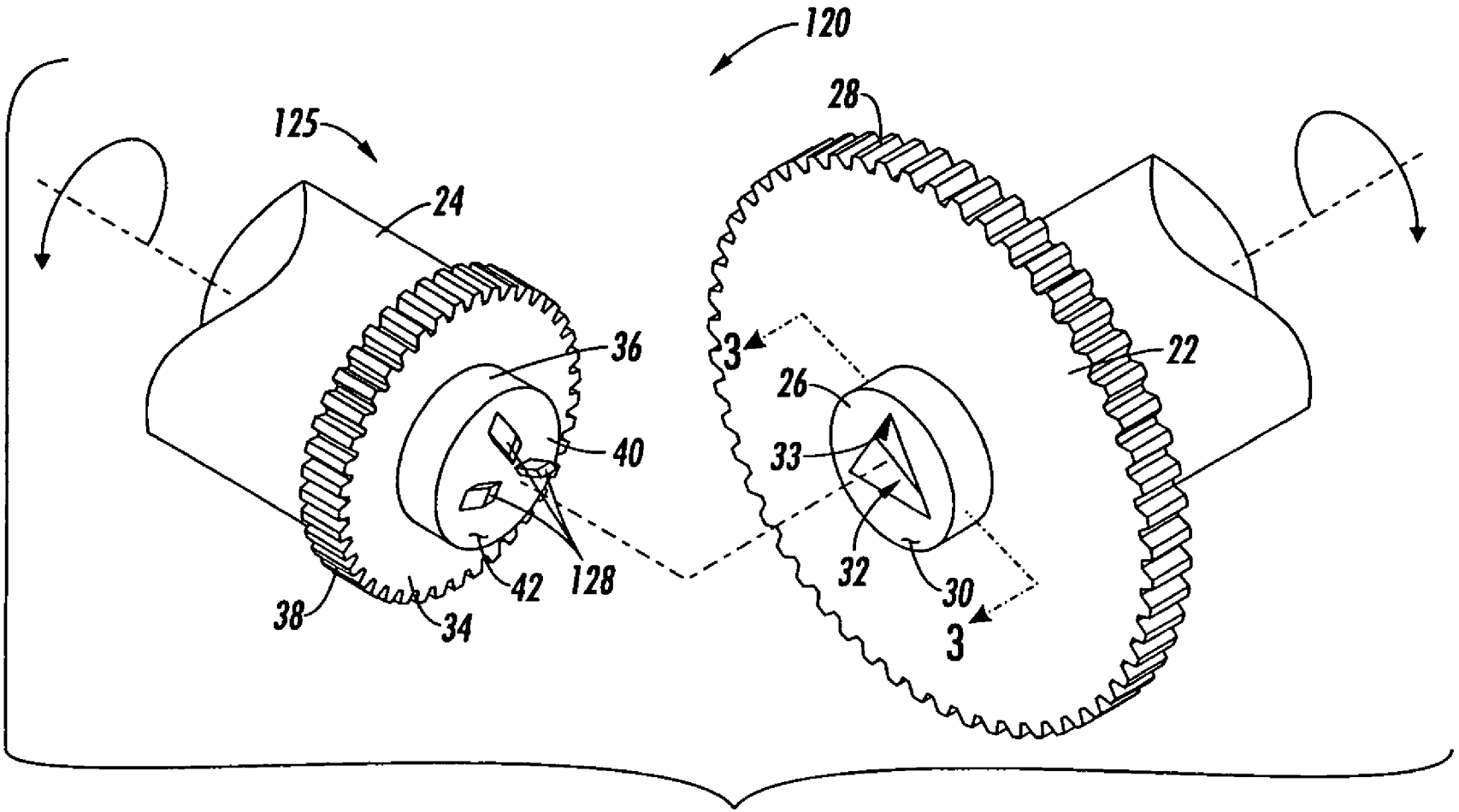
FIG. 2 is a drive shaft and gear shaft coupling arrangement according to one embodiment of the present application.

FIG. 2 is a drive shaft and gear shaft coupling arrangement 120. Arrangement 120 has a drive shaft 125 for coupling with drive gear 22, which includes gear shaft 26 extending outwardly therefrom. Drive shaft 125 is similar to drive shaft 25 as reflected by similar or identical element numbers. Gear shaft 26 includes twisted triangular coupling hole 32, which has defined vertices 33. Drive shaft 125 includes cylinder flange 34 joined to one end of drive shaft cylinder 24. Cylinder flange 34 has a concentric shaft 36 extending longitudinally outwardly therefrom and an outside edge having gear teeth 38 defined therein. A plurality of members 128 extending longitudinally outwardly from concentric shaft 36. Concentric shaft 36 and plurality of members 128 extend longitudinally outwardly with respect to the longitudinal axis of drive shaft 125, around which the drive shaft rotates as indicated by the rotational arrows. Plurality of members 128 are adapted to fit within twisted triangular coupling hole 32. In FIG. 2, plurality of members 128 are three parallelogram-shaped prongs. In other embodiments, plurality of members 128 may be any shape providing they extend longitudinally outwardly from concentric shaft 36 and fit within twisted triangular coupling hole 32.

Figure 3:
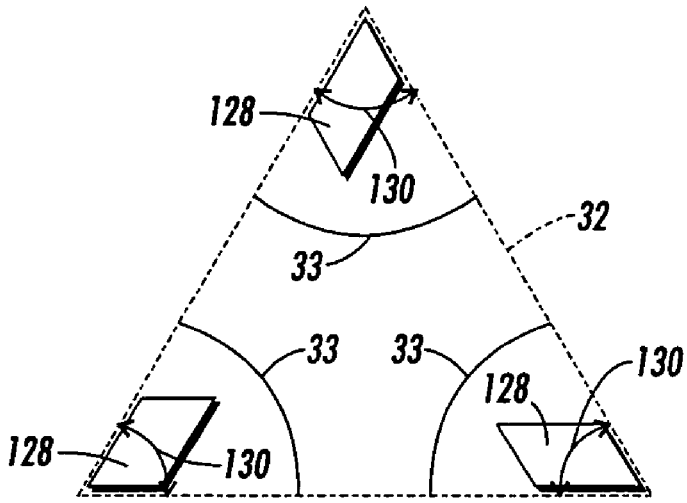
FIG. 3 is a section view take along line 3-3 of FIG. 2.
Figure 4:
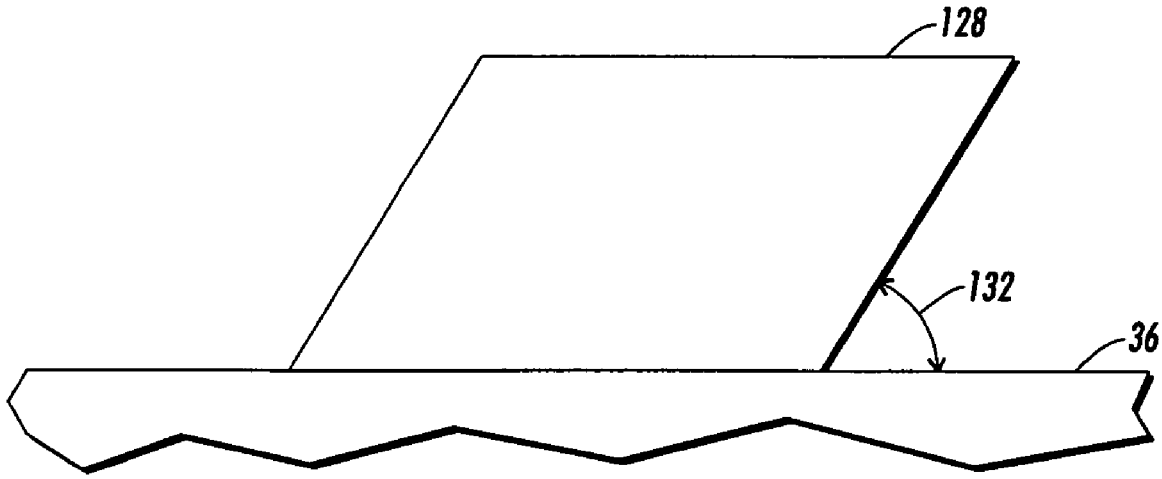
FIG. 4 is a side view of one of the three parallelogram-shaped prongs in FIG. 2.
Figure 5:
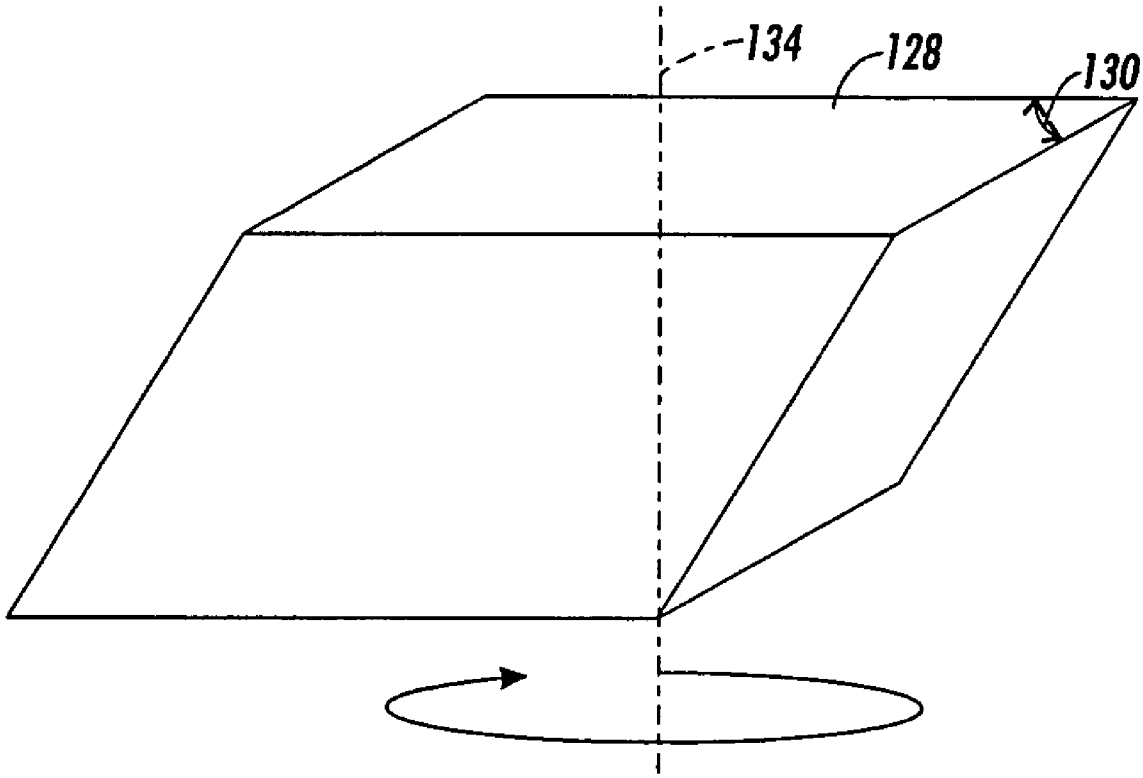
FIG. 5 is a front isometric view of one of the three parallelogram-shaped prongs in FIG. 2.

Referring now to FIGS. 3-5, in one embodiment, each of parallelogram-shaped prongs 128 includes an outward facing angle 130 of about 60°, which substantially matches the angle of one of vertices 33 of twisted triangular coupling hole 32. Typically, each of parallelogram-shaped prongs 128 has a particular vertical angle 132, which helps each prong substantially match the twist of twisted triangular coupling hole 32. Each of parallelogram-shaped prongs 128 may also be axially twisted along an axis 134, which is parallel to concentric shaft 36, so as to better fit in twisted triangular coupling hole 32.

Referring again to FIG. 2, outer surface 42 of concentric shaft 36 defines a plane that is generally substantially perpendicular to the longitudinal axis of the concentric shaft. Outer surface 42 is typically adapted to be substantially parallel to front surface 30 of gear shaft 26. Plurality of members or parallelogram-shaped prongs 128 extend longitudinally outwardly from outer surface 42 of concentric shaft 36.

Figure 6:
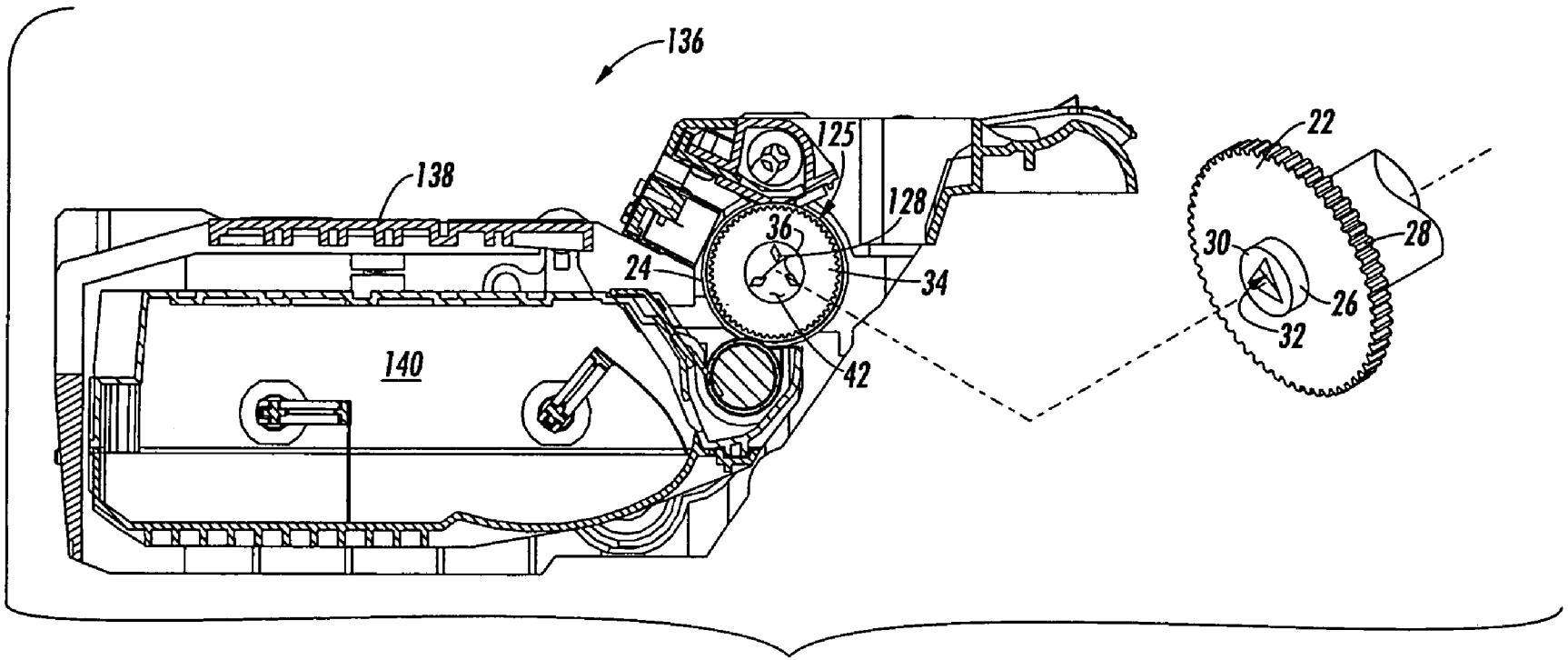
FIG. 6 is a material supply module according to one embodiment of the present application.

Referring now to FIG. 6, another embodiment is a module installable in a printing apparatus, i.e., a material supply module 136 adapted for coupling with drive gear 22, which includes gear shaft 26 extending outwardly therefrom. As mentioned above, gear shaft 26 includes twisted triangular coupling hole 32, which has defined vertices 33. Material supply module 136 includes a housing 138 and drive shaft 125, which may be removably joined with the housing. Housing 138 generally includes an integral reservoir 140 for containing materials. However, reservoir 140 may also be separate but connectable to housing 138. Again, drive shaft 125 is similar to drive shaft 25 as reflected by similar or identical element numbers. Drive shaft 125 includes cylinder flange 34, which is joined to one end of drive shaft cylinder 24. Concentric shaft 36 extends outwardly from cylinder flange 34 and includes outer surface 42, which is configured to be substantially parallel to front surface 30 of gear shaft 26. Plurality of members or parallelogram-shaped prongs 128 extend longitudinally outwardly from outer surface 42 of concentric shaft 36. Members 128 generally are adapted to engage twisted triangular coupling hole 32.

Figure 7:
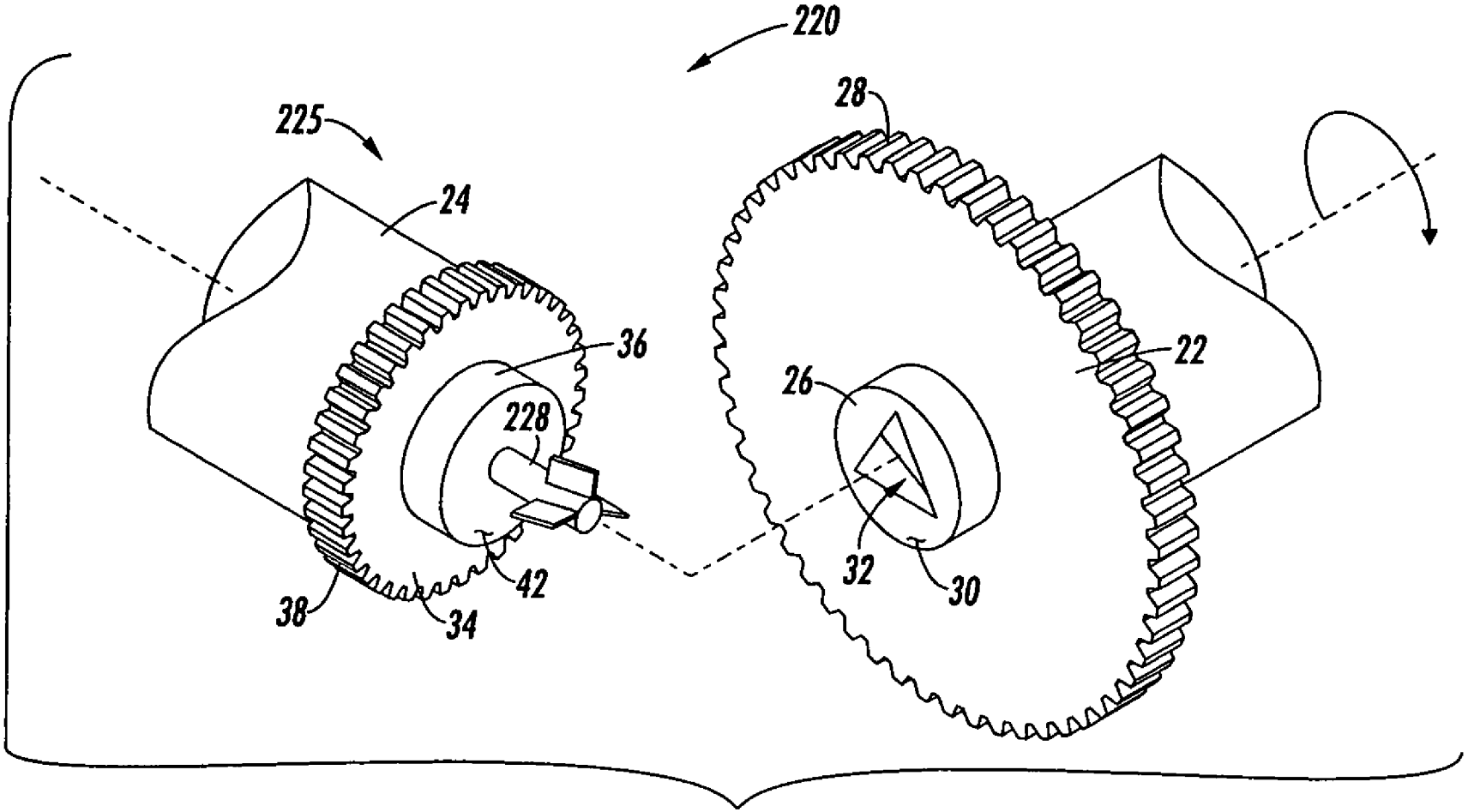
FIG. 7 is a drive shaft and gear shaft coupling arrangement according to one embodiment of the present application.

Referring now to FIG. 7, a drive shaft and gear shaft coupling arrangement 220 includes another embodiment, a drive shaft 225. Drive shaft 225 couples with drive gear 22, which includes gear shaft 26 extending outwardly therefrom. Drive shaft 225 is similar to drive shaft 25 as reflected by similar or identical element numbers. Gear shaft 26 includes twisted triangular coupling hole 32, which has defined vertices 33. Drive shaft 225 includes cylinder flange 34 joined to one end of drive shaft cylinder 24. Cylinder flange 34 has a concentric shaft 36 extending outwardly therefrom and an outside edge having gear teeth 38 defined therein. A rod 228 extends outwardly from concentric shaft 36. Rod 228 has three skewed blades 230 extending radially outwardly therefrom. Rod 228 and blades 230 are adapted to fit within twisted triangular coupling hole 32. Each of blades 230 is typically configured so as to fit in one of vertices 33 of twisted triangular coupling hole 32.

The embodiments described herein offer advantages over the prior art. First, because parallelogram-shaped prongs 128 are spaced radially outward from the axis of rotation of drive shaft cylinder 24, the stress transferred from the torque generated between drive gear 22 and drive shaft 125, which is in turn transferred to the parts that make-up drive shaft 25, is reduced. As a result, materials of lesser strength may be used in fabricating drive shaft 125.

Second, in a configuration like arrangement 20, where the coupling is between a triangular-shaped male portion and a triangular-shaped female portion, the fabrication tolerances for both the male and female portions is small. If either portion is out of tolerance, the portions will fail to fit together. In contrast, in a configuration such as arrangement 120, the prongs will allow for a certain amount of flex thereby increasing the overall manufacturing tolerance of the arrangement. Because the prongs will have some flex, they will still be able to couple with the female portion over a wider range of manufacturing tolerances for both the male and female portions.

Finally, drive shaft 225 offers a leaner design over prior art configurations. As a result, less material is needed to fabricate drive shaft 225.

It should be understood that any of the features, characteristics, alternatives, or modifications described regarding a particular embodiment herein may also be applied, used, or incorporated with any other embodiment described herein.

A number of embodiments have been described. Nevertheless, it will be understood that various modifications may be made without departing from the spirit and scope of the invention. Accordingly, other embodiments are within the scope of the following claims.

What is claimed is:

1. A drive shaft for coupling with a drive gear having a gear shaft extending outwardly therefrom, the gear shaft including a twisted triangular coupling hole having defined vertices, said drive shaft comprising:

a cylinder flange joined to one end of a drive shaft cylinder, said cylinder flange having a concentric shaft extending longitudinally outwardly therefrom, said concentric shaft including an outer surface that is substantially perpendicular to said concentric shaft and adapted to be substantially parallel to a front surface of the gear shaft and a plurality of members extending longitudinally outwardly from said outer surface of said concentric shaft, wherein said members are adapted to fit within the twisted triangular coupling hole.

2. A drive shaft according to claim 1, wherein said plurality of members is three parallelogram-shaped prongs.

3. A drive shaft according to claim 2, wherein each of said parallelogram-shaped prongs includes an outward facing angle of about 60°.

4. A drive shaft according to claim 3, wherein each outward facing angle is adapted to substantially match one of the vertices of the twisted triangular coupling hole.

5. A drive shaft according to claim 2, wherein each of said parallelogram-shaped prongs has a particular vertical angle to substantially match the twist of the twisted triangular coupling hole.

6. A drive shaft according to claim 2, wherein each of said parallelogram-shaped prongs are axially twisted along an axis parallel to said concentric shaft so as to better fit in the twisted triangular coupling hole.

7. A drive shaft according to claim 1, wherein said cylinder flange includes an outside edge having gear teeth defined therein.

8. A module installable in a printing apparatus, said module adapted for coupling with a drive gear, the drive gear having a gear shaft extending outwardly therefrom, the gear shaft including a twisted triangular coupling hole having defined vertices therein, said module comprising:

a housing;

a drive shaft joined with said housing, said drive shaft including a cylinder flange joined to one end of a drive shaft cylinder, said cylinder flange having a concentric shaft extending longitudinally outwardly therefrom, said concentric shaft including an outer surface that is substantially perpendicular to said concentric shaft and adapted to be substantially parallel to a front surface of the gear shaft; and a plurality of members extending outwardly from said outer surface of said concentric shaft, wherein said members include means for engaging the twisted triangular coupling hole.

9. A module according to claim 8, further comprising a reservoir in said housing for containing material.

10. A module according to claim 8, wherein each of said plurality of members is a parallelogram-shaped prong having an outward facing angle of about 60°.

11. A module according to claim 10, wherein each outward facing angle is configured to substantially match one of the vertices of the twisted triangular coupling hole.

12. A module according to claim 8, wherein each of said plurality of members has a particular vertical angle so as to substantially match the twist of the twisted triangular coupling hole.

13. A module according to claim 8, wherein each of said plurality of members is axially twisted along an axis parallel to said concentric shaft so as to better fit in the twisted triangular coupling hole.

14. A module according to claim 8 wherein said plurality of members are parallelogram-shaped prongs that extend outwardly from said outer surface of said concentric shaft.

15. A drive shaft for coupling with a drive gear having a gear shaft extending outwardly therefrom, the gear shaft including a twisted triangular coupling hole having defined vertices, said drive shaft comprising:

a cylinder flange joined to one end of a drive shaft cylinder, said cylinder flange having a concentric shaft extending longitudinally outwardly therefrom; said concentric shaft including an outer surface that is substantially perpendicular to said concentric shaft and adapted to be substantially parallel to a front surface of the gear shaft and rod extending outwardly from said outer surface of said concentric shaft, said rod having three skewed blades extending radially outwardly therefrom, wherein said rod and said blades are adapted to fit within the twisted triangular coupling hole.

16. A drive shaft according to claim 15, wherein each of said skewed blades are configured so as to fit in one of the vertices of the twisted triangular coupling hole.

17. A drive shaft according to claim 15, wherein said cylinder flange includes an outside edge having gear teeth defined therein.

18. A drive shaft for coupling with a drive gear having a gear shaft extending outwardly therefrom, the gear shaft including a twisted triangular coupling hole having dpfined vertices, said drive shaft comprising:

a cylinder flange joined to one end of a drive shaft cylinder, said cylinder flange having a concentric shaft extending longitudinally outwardly therefrom; said concentric shaft including an outer surface that is substantially perpendicular to said concentric shaft and adhpted to be substantially parallel to a front surface of the gear shaft and three spaced apart parallelogram-shaped prongs extending longitudinally outwardly from said outer surface of said concentric shaft, each of said prongs including an outward facing angle adapted to substantially match one of the vertices of the twisted triangular coupling hole and each prong being axially twisted along an axis parallel to said concentric shaft enabling said prongs to fit within said twisted triangular coupling hole.

* * * * *